US005660789A

United States Patent [19]

Spagnoli et al.

[11] Patent Number: 5,660,789

[45] Date of Patent: Aug. 26, 1997

[54] SPINNING PROCESS FOR THE PREPARATION OF HIGH THERMOBONDABILITY POLYOLEFIN FIBERS

[75] Inventors: Leonardo Spagnoli; Giancarlo Braca, both of Terni; Leonardo Pinoca, Narni, all of Italy

[73] Assignee: Montell North America Inc., Wilmington, Del.

[21] Appl. No.: 712,230

[22] Filed: Sep. 11, 1996

Related U.S. Application Data

[63] Continuation of Ser. No. 339,433, Nov. 14, 1994, abandoned, which is a continuation-in-part of Ser. No. 259,317, Jun. 13, 1994, abandoned.

[30] Foreign Application Priority Data

| | | | |
|---|---|---|---|
| Jun. 17, 1993 | [IT] | Italy | MI93A1308 |
| Mar. 4, 1994 | [IT] | Italy | MI94A0390 |

[51] Int. Cl.[6] ..... D01D 5/092; D01D 5/26; D01F 6/06

[52] U.S. Cl. ..... 264/555; 264/143; 264/168; 264/210.7; 264/210.8; 264/211.12; 264/211.14; 264/211.15

[58] Field of Search ..... 264/143, 168, 264/210.7, 210.8, 211.12, 211.14, 211.15, 555

[56] References Cited

U.S. PATENT DOCUMENTS

| | | | |
|---|---|---|---|
| 4,211,819 | 7/1980 | Kunimune et al. | 428/374 |
| 5,281,378 | 1/1994 | Kozulla | 264/83 |
| 5,318,735 | 6/1994 | Kozulla | 264/83 |

FOREIGN PATENT DOCUMENTS

| | | |
|---|---|---|
| 552 013 | 7/1993 | European Pat. Off. . |
| 630 996 | 12/1994 | European Pat. Off. . |

*Primary Examiner*—Leo B. Tentoni

[57] ABSTRACT

Polyolefin fibers, suitable for the preparation of nonwoven fabrics, prepared by using a spinneret or extruder with dies having a real or equivalent output diameter of the capillaries or holes greater than 0.4 mm, with the proviso that for fibers having a denier greater than or equal to 4 dtex, the ratio of the output capillary or hole diameter to the denier is greater than or equal to 0.06 mm/dtex.

20 Claims, No Drawings

SPINNING PROCESS FOR THE PREPARATION OF HIGH THERMOBONDABILITY POLYOLEFIN FIBERS

This application is a continuation of application Ser. No. 08/339,433, filed on Nov. 14, 1994, now abandoned, which is a continuation-in-part of application Ser. No. 08/259,317, filed on Jun. 13, 1994, now abandoned.

The present invention relates to a spinning process for the preparation of thermobondable polyolefin fibers, in particular polypropylene based fibers, suitable for the preparation of nonwoven fabrics.

As used herein the term "fiber" embraces both staple fibers and continuous filaments.

Said nonwoven fabrics are particularly suitable for uses requiring considerable softness and tear resistance, as is the case with coverstock for diapers and sanitary wear, which are made from fine denier fibers, generally ranging from 0.2 to 4 dtex, or for uses as geomembranes or in agricultural applications, in which uses the nonwoven fabrics are made from fibers having a denier between 3 and 10 dtex. The fundamental requirement of polyolefin fibers for nonwoven fabrics is that they must bond to each other by means of the joint action of temperature and pressure on which the hot calendering processes are based. This characteristic, called "thermobondability", or "thermoweldability" is not always present in polyolefin fibers in the same degree. In fact, thermobondability basically depends on the type of polyolefin being spun, the additives it contains, the type of process used and the spinning conditions employed.

Published European patent application 391438 describes polyolefin compositions suitable for spinning and characterized by the presence of stabilizers selected from organic phosphites and/or phosphonites, HALS (hindered amine light stabilizers) and, optionally, phenolic antioxidants.

The same patent application describes thermobondable fibers obtained from the above mentioned stabilized polyolefin compositions by conventional spinning processes, in particular processes for the production of staple fibers. In this case the good levels of thermobondability shown in the examples are due to the selection of the stabilizers. In the above mentioned examples fibers having a denier ranging from 1.9 to 2.2 dtex are prepared by using a typical "long-spinning" apparatus equipped with a die having capillaries, also referred to as holes, with 0.4 mm diameter.

The use of dies having capillaries with a small diameter (less than or equal to 0.4 mm) to produce fine denier fibers is typical of both the above mentioned long-spinning apparatus, as well as the "short-spinning" apparatus, both used for producing staple fibers, and of the spun-bonding machines, because it enables high production levels to be obtained.

In fact, the smaller the diameter of the capillaries, the greater the number of capillaries in the die, which means more fibers per unit of time. This is the reason why in the art the use of dies with diameters of the holes greater than 0.4 mm is limited to the production of high-denier fibers (higher than 4 dtex).

Now it has surprisingly been found that, both in the production of staple fibers and in the spun-bonding process, the use of dies with capillaries having diameters greater than 0.4 mm results in a marked increase of the thermobondability of the fibers, provided that, for fibers having a denier greater than or equal to 4 dtex, the ratio of capillary diameter to the denier is high enough.

Accordingly, the present invention provides a process for the preparation of thermobondable fibers having preferably a denier ranging from 0.2 to 10 dtex, more preferably from 0.5 to 3 dtex, wherein the dies of the spinneret or extruder used have a real or equivalent output diameter of the capillaries (or holes) of greater than 0.4 mm, preferably from greater than 0.5 to 2 mm, more preferably from 0.6 to 1 mm, with the proviso that for fibers having a denier greater than or equal to 4 dtex, the ratio of the output capillary diameter to the denier is greater than or equal to 0.06 mm/dtex, preferably greater than or equal to 0.08 mm/dtex, more preferably greater than or equal to 0.1 mm/dtex.

As used herein, "output diameter of the capillaries" is the diameter of the capillaries at the outside surface of the die, i.e., on the front face of the die from which the fibers exit. Inside the thickness of the die, the diameter of the capillaries can be different from the diameter of the capillaries at the output. The "equivalent output diameter of the capillaries" refers to instances where the capillary is not round, in which case, for the purpose of the present invention, one considers the diameter of the ideal circle having an area equal to the area of the output capillary, which corresponds to the above mentioned equivalent diameter.

The use of dies with capillaries having real or equivalent output diameters greater than 0.4 mm according to the present invention promotes a controlled oxidative degradation of the polymer in a zone (sheath) at the outer surface of the fibers, so that the molecular weight in the sheath portion of the fibers is lower than that in the inner or core portion of the same. Consequently, the fibers are capable of efficient thermobonding at lower temperature and stronger bonds between the fibers can be formed in the obtained nonwoven fabrics.

This sheath/core structure of the fibers, which is obtained by the process of the present invention, can be evidenced by SEM photomicrographs and by the higher strength of the nonwoven fabrics produced from the fibers.

Larger real or equivalent capillary output diameters tend to increase the degree of said oxidative degradation.

In order to achieve suitable degrees of oxidative degradation, said diameters shall be preferably from 0.5 to 2 mm, more preferably from 0.6 to 1 mm.

It has been also found that, when carrying out the process of the present invention, said formation of a sheath/core structure of the fibers can be further promoted by maintaining the polymer in the extruder and/or in the die at a temperature higher than that usually employed for extruding or spinning the given polymer.

According to the present invention the extruded polymer temperature (i.e. the temperature of the polymer in the die) is preferably greater than 230° C.

In the case of staple fibers, more preferably the extruded polymer temperature is from 240° C. to 320° C., most preferably from 270° C. to 300 C.

In the case of continuous filaments in a spun-bonding process, more preferably the extruded polymer temperature is from 230° C. to 320° C., most preferably from 240° C. to 300° C.

After exiting the extrusion die, the olefin polymer continues to undergo thermo-oxidative and photo-oxidative degradation.

The temperature of the polymer as it exits the die capillary, and before it is significantly quenched, will affect the degree of oxidative degradation.

Moreover, the oxidative degradation which provides said sheath/core structure can be controlled by regulating the level of stabilizers and antioxidants in the polymer, the flow rate of the polymer in the capillary and the temperature and speed of the cooling air flow used to quench the fibers.

Moreover, it has been also found that, in the process of the present invention, olefin polymers having a melt flow rate lower than that of polymers used in conventional spinning processes can be extruded through a heated die, in such a way that the process and polymer rheology conditions are suitable for stable, high-speed spinning of fine denier fibers.

The present invention may be applied, for instance, both to the production of staple fibers suitable for the manufacture of nonwoven fabrics and to the production of continuous filaments in a spun-bonding process for the manufacture of nonwoven fabrics.

As regards the production of staple fibers, the process of the present invention can be carried out by using both long-spinning and short-spinning apparatuses.

Long-spinning apparatuses normally comprise a first spinning section where the fibers are extruded and air-cooled in a quenching column. Subsequently, these fibers go to the finishing steps during which they are drawn, crimped-bulked and cut. Generally, the above mentioned finishing steps are carried out in a specific section where the fiber rovings are gathered into one single roving (tow) having a total denier ranging from 100 and 200 kilotex. Said roving is sent to drawing, crimping-bulking and cutting apparatuses which operate in sequence at a speed ranging from 100 to 200 m/min, but not in continuous sequence with the spinning step. In other types of long-spinning apparatuses the above mentioned finishing steps are carried out in sequence with the spinning step. In this case the fibers go directly from the gathering to the drawing rollers, where they are drawn at a somewhat contained ratio. Subsequently, they are gathered in rovings with a denier of about 5 kilotex, then subjected to crimping-bulking and cutting at a speed comparable with that of the spinning.

The long-spinning apparatuses allow for a better control of the process parameters compared to the control which is possible with the short-spinning apparatuses. The process conditions which are generally adopted when using the long-spinning apparatuses are the following:

capillary flow rate >0.1 g/min;

filament speed ≧500 m/min;

space where the filaments cool off and solidify after exiting the die >0.50 m.

The above mentioned conditions can also be used in the process of the present invention when it is carried out in a long-spinning apparatus and the dies used have diameters of the capillaries as defined above.

According to the present invention, in a long-spinning apparatus, preferably one operates within the following ranges:

capillary flow rate from 0.15 to 1.0 g/min, preferably from 0.2 to 0.5 g/min;

filament speed from 500 to 3500 m/min, preferably from 600 to 2000 m/min.

Moreover, it is preferable that the draw ratio be from 1.1 to 4.0.

For further details on the long-spinning apparatuses reference is made to Friedhelm Hauser "Plastics Extrusion Technology", Hauser Publishers, 1988, chapter 17.

It has been found that thermobondability of staple fibers improves as the filament speed decreases. Therefore, in the case of staple fibers, the process of the present invention is particularly advantageous when the short-spinning apparatuses are used, said apparatuses being characterized, among other things, by low filament speeds (less than or equal to 500 m/min).

The above mentioned short-spinning apparatuses allow for a continuous operation, since the spinning speed is compatible with the drawing, crimping and cutting speeds, and due to their simplicity and reduced overall volume, these apparatuses are more economical than the long-spinning ones. However, up until now short-spinning apparatuses did not allow one to obtain staple fibers having good thermobondability values (higher than 2.5N, for example, according to the measuring method described in the Examples). The process of the present invention, therefore, assumes particular importance when short-spinning apparatuses are used, because it solves the problem of producing thermobondable staple fibers even when operating with said apparatuses.

The process conditions which are best suitable to be used according to the present invention using short-spinning apparatuses are the following.

The capillary flow rate ranges from 0.005 to 0.18 g/min, preferably from 0.008 to 0.070 g/min, more preferably from 0.010 to 0.030 g/min. The filament speed ranges from 30 to 500 m/min, preferably from 40 to 250 m/min, more preferably from 50 to 100 m/min. The draw ratios range from 1.10 to 3.50, preferably from 1.20 to 2.50. Moreover, the fiber cooling and solidification space at the output of the die (cooling space) is preferably greater than 2 mm, more preferably greater than 10 mm, in particular from 10 to 350 mm. Said cooling is generally induced by an air jet or flow. The pre-cooling space (i.e. the distance between the die and the above mentioned air jet or flow) is extremely reduced (generally from 0 to 2 mm) in conventional short-spinning apparatuses. According to the present invention, said distance is preferably greater than 2 mm.

Moreover, according to the present invention, when using a short-spinning apparatus, it is preferable that the draw temperature be lower than 100° C., in particular it should range from 15° C. to 50° C. For further details on the short-spinning apparatuses reference is made to M. Ahmed, "Polypropylene fibers science and technology", Elsevier Scientific Publishing Company (1982) pages 344–346.

The extruded polymer temperature in the above long-spinning and short-spinning apparatuses for the production of staple fibers preferably ranges from 240° C. to 320° C., more preferably from 270° C. to 300° C.

As stated above, the process of the present invention can be carried out also in spun-bonding apparatuses. A spun-bonding apparatus normally includes an extruder with a die on its spinning head, a cooling tower, and an air suction gathering device. Underneath this device, the filaments are usually gathered over a conveyor belt, where they are distributed forming a web which is thermobonded in a calender.

In accordance with one well-known type of spunbonding process, known as the Lurgi process, the continuous filament of thermoplastic polymer are attenuated and drawn by passing through Venturi tubes. Pressurized air supplied to the Venturi tubes accelerates the filaments to a linear velocity on the order of 3500 meters per minute, causing attenuation and drawing of the filamentary polymer extrudate. The rapidly moving filaments are discharged from the Venturi tubes and deposited on a moving belt or wire to form a web. The filaments of the web are then bonded at filament intersections to render the web coherent and impart strength to the nonwoven fabric. The bonding may, for example, be carried out by passing the web of filaments through the nip of a pair of cooperating heated calendar rolls. One of the calendar rolls may be engraved with a pattern of raised areas or lands so that the bonding forms individual discrete bond areas throughout the fabric.

In other known spun-bonding processes, the freshly extruded filaments of thermoplastic polymer are attenuated and drawn by an attenuater device in the form of an elongate slot rather than by individual Venturi tube attenuaters. The slot extends in the cross-machine direction typically the full width of the nonwoven fabric. Air is caused to move downwardly through the elongate slot, entraining the filaments and causing them to be attenuated and drawn before being discharged from the slot and deposited on a moving belt or wire. This type of "slot-draw" system accelerates the filaments to speeds in excess of 1500 meters per minute, and typically within the range of 2000 to 4500 meters per minute.

According to this invention, when using typical spun-bonding apparatuses, it is convenient to apply the process conditions that follows.

The capillary flow rate ranges from 0.1 to 2.0 g/min; preferably from 0.2 to 1.0 g/min. The filament speed is greater than 400 m/min, preferably from 1000 to 4000 m/min.

The space where fibers cool and solidify after leaving the die (the cooling space) is preferably greater than 2 mm, more preferably greater than 10 mm and in particular in the range between 10 and 350 mm. The fibers are generally cooled by means of an air jet or flow.

The extruded polymer temperature is preferably from 230° C. to 320° C., more preferably from 240° C. to 300° C.

Generally, the olefin polymers that can be used in the process of the present invention for the production of thermoweldable fibers are homopolymers or copolymers, and their mixtures, of R—CH=$CH_2$ olefins where R is a hydrogen atom or a $C_1$–$C_6$ alkyl radical. Particularly preferred are the following polymers:

1) isotactic or mainly isotactic propylene homopolymers, preferably having an isotactic index of at least 90;
2) crystalline copolymers of propylene with ethylene and/or k-$C_4$–$C_8$ alpha-olefins, such as for example 1-butene, 1-hexene, 1-octene, 4-methyl-1-pentene, wherein the total comonomer content ranges from 0.05% to 20% by weight, or mixtures of said copolymers with isotactic or mainly isotactic propylene homopolymers;
3) heterophasic copolymers comprising (A) a propylene homopolymer and/or one of the copolymers of item 2), and an elastomeric fraction (B) comprising copolymers of ethylene with propylene and/or a k-$C_4$–$C_8$ s alpha-olefin, optionally containing minor quantities of a diene, such as butadiene, 1,4-hexadiene, 1,5-hexadiene, ethylidene-1-norbornene. Preferably the amount of diene in (B) is from 1% to 10% by weight.

The heterophasic copolymers (3) are prepared according to known methods by mixing the components in the molten state, or by sequential copolymerization, and generally contain the copolymer fraction (B) in quantities ranging from 5% to 80% by weight.

Specific examples of olefin polymers particularly suitable for the preparation of thermoweldable fibers are the following propylene random copolymers:

a) crystalline propylene random copolymers containing from 1.5% to 20% by weight of ethylene or $C_4$–$C_8$ alpha-olefins;
b) crystalline propylene random copolymers containing from 85% to 96% by weight of propylene, from 1.5% to 5% by weight of ethylene, and from 2.5% to 10% by weight of a $C_4$–$C_8$ alpha-olefin;
c) crystalline propylene random copolymers compositions comprising (percentages by weight):
   (1) from 30% to 65% of a copolymer of propylene with a $C_4$–$C_8$ alpha-olefin, containing from 80% to 98% of propylene; and
   (2) from 35% to 70% of a propylene copolymer with ethylene, and optionally with a $C_4$–$C_8$ alpha-olefin in quantity ranging from 2% to 10%; said copolymer containing from 2% to 10% of ethylene when the above mentioned $C_4$–$C_8$ alpha-olefin is not present, and from 0.5% to 5% of ethylene when the $C_4$–$C_8$ alpha-olefin is present;
d) compositions of crystalline propylene random copolymers and crystalline ethylene copolymers comprising (percentages by weight):
   (1) from 40% to 70% of one or more crystalline propylene copolymers with one or more comonomers selected from ethylene and/or $C_4$–$C_8$ alpha-olefin, wherein the comonomer or comonomers content is from 5% to 20%;
   (2) from 30% to 60% of LLDPE having a MFR E (according to ASTM D 1238) from 0.1 to 15.

The above mentioned copolymers can also be used mixed with each other and/or with isotactic or mainly isotactic propylene homopolymers.

Other specific examples of olefin polymers particularly suitable for the preparation of thermobondable fibers are heterophasic copolymers comprising from 5% to 95% by weight of an isotactic or mainly isotactic propylene homopolymer, preferably having isotactic index of at least 90, and/or a random propylene copolymer of the above mentioned types from a) to d), and from 95% to 5% by weight of a composition selected from:

(I) a composition comprising:
   (i) 10–60 parts by weight of propylene homopolymer with an isotactic index of at least 90, or of a crystalline copolymer of propylene with ethylene and/or another $C_4$–$C_8$ alpha-olefin, containing over 85% by weight of propylene, and having an isotactic index higher than 85;
   (ii) 10–40 parts by weight of a crystalline polymer fraction containing ethylene, insoluble in xylene at ambient temperature;
   (iii) 30–60 parts by weight of an amorphous ethylene-propylene copolymer fraction optionally containing minor portions of a diene, soluble in xylene at ambient temperature and containing from 40 to 70% by weight of ethylene;

(II) a composition comprising:
   (i) 10–50 parts by weight of propylene homopolymer with an isotactic index higher than 80, or a copolymer of propylene with ethylene and/or a $C_4$–$C_8$ alpha-olefin containing over 85% by weight of propylene;
   (ii) 5–20 parts by weight of a copolymer fraction containing ethylene, insoluble in xylene at ambient temperature;
   (iii) 40–80 parts by weight of a copolymer fraction of ethylene with propylene and/or a $C_4$–$C_8$ alpha-olefin, and optionally with minor portions of diene, containing less than 40% by weight of ethylene, said fraction being soluble in xylene at ambient temperature, and having an intrinsic viscosity ranging from 1.5 to 4 dl/g.

Specific examples of $C_4$–$C_8$ alpha olefins and dienes have been given above.

Generally, when used in the production of staple fibers the above mentioned olefin polymers have a Melt Flow Rate (MFR), determined according to ASTM D 1238-L, ranging from 0.5 to 100 g/10 min., preferably from 1.5 to 35 g/10 min.

When used in the spun-bonding apparatuses with the process of the present invention, the above mentioned olefin polymers have preferably a MFR value between 2 and 40 g/10 min., more preferably from 5 to 25 g/10 min, most preferably from 8 to 18 g/10 min.

The above said values of melt flow rate are obtained directly in polymerization, or by controlled degradation. In order to obtain said controlled degradation one adds, for example, organic peroxides in the spinning line or in the preceding steps of pelletization of the olefin polymers. Olefin polymers are generally used in the form of pellets or nonextruded particles, such as flakes or spheroidal particles, for example.

Since olefin polymers almost universally undergo some level of degradation in the extrusion process, stabilizers and/or antioxidants are conventionally added to the olefin polymer. The level and kind of stability and/or antioxidant can affect the degree to which the polymer undergoes degradation. The stabilizer and/or antioxidant concentration in the olefin polymer typically may range from 0–1% by weight. When present, the antioxidant/stabilizer is preferably within a range of abut 0.005%–0.5%.

Antioxidant and/or stabilizer compositions which can be used include at least compounds selected from the group consisting of organic phosphites, organic phosphonites, hindered phenols, and hindered amines.

Preferably the olefin polymers which are subjected to spinning with either process of the present invention are stabilized with the types and quantities of stabilizers described in published European patent application 391438. According to said patent application the polyolefins to be used for spinning contain one or more of the following stabilizers:

a) from 0.01 to 0.5% by weight of one or more organic phosphites and/or phosphonites;
b) from 0.005 to 0.5% by weight of one or more HALS (Hindered Amine Light Stabilizer); and optionally one or more phenolic antioxidants in concentration which does not exceed 0.02% by weight.

The above stabilizers can be added to the polyolefins by means of pelletization or surface coating, or they can be mechanically mixed with the polyolefins.

Specific examples of phosphites are:

tris(2,4-di-tert-butylphenyl)phosphite marketed by Ciba Geigy under the trademark Irgafos 168; distearyl pentaerythritol diphosphite marketed by Borg-Warner Chemical under the trademark Weston 618; 4,4'-butylidenebis(3-methyl-6-tert-butylphenyl-di-tridecyl) phosphite marketed by Adeka Argus Chemical under the trademark Mark P; tris(monononylphenyl)phosphite; bis (2,4-di-tert-butyl)pentaerythritol diphosphite, marketed by Borg-Warner Chemical under the trademark Ultranox 626.

A preferred example of phosphonites is the tetrakis(2,4-di-tert-butylphenyl) 4,4'-diphenylilenediphosphonite, on which Sandostab P-EPQ, marketed by Sandoz, is based.

The HALS are monomeric or oligomeric compounds containing in the molecule one or more substituted amine, preferably piperidine, groups.

Specific examples of HALS containing substituted piperidine groups are the compounds sold by Ciba-Geigy under the following trademarks:

Chimassorb 944
Chimassorb 905
Tinuvin 770
Tinuvin 292
Tinuvin 622
Tinuvin 144
Spinuvex A36 and the product sold by American Cyanamid under the mark Cyasorb UV 3346.

Examples of phenolic antioxidants are: tris-(4-tert-butyl-3-hydroxy-2,6-dimethylbenzyl)-s-triazine-2-4-6-(1H,3H, 5H)-trione, marketed by American Cyamamid under the trademark Cyanox 1790; calcium bi[monoethyl(3,5-di-tert-butyl-4-hydroxy-benzyl)-phosphonate]; 1,3,5-tris(3,5-di-tert-butyl-4-hydroxybenzyl)-s-triazine-2,4,6(1H,3H,5H) trione; 1,3,5-trimethyl-2,4,6-tris(3,5-di-tert-butyl-4-hydroxybenzyl)benzene; pentaerythrityl-tetrakis[3-(3,5-di-tert-butyl-4-hydroxyphenyl)propionate]; octadecyl 3-(3,5-di-tert-butyl-4-hydroxyphenyl)propionate, marketed by CIBA GEIGY under the trademarks Irganox 1425; Irganox 3114; Irganox 1330, Irganox 1010, Irganox 1076 respectively; 2,6-dimethyl-3-hydroxy-4-tert-butyl benzyl abietate.

Other additives conventionally used in the production of continuous polymer filaments can also be incorporated in the polymer such as UV stabilizers, pigments, delusterants, lubricants, antistatic agents, water and alcohol repellents, etc. in the conventional amounts, which are typically no more than about 10% by weight.

The following examples are given in order to illustrate and not limit the present invention.

EVALUATION OF THE THERMOBONDABILITY OF THE FIBERS

Generally, in order to evaluate the thermobondability of fibers, a nonwoven fabric is prepared from the fiber being tested by calendering under certain given conditions. Subsequently, the tension needed to tear said nonwoven fabric both in the direction parallel and transverse to the calendering is measured.

The tension value determined in this way is considered a measure of the fiber thermobonding capability.

The result, however, is influenced substantially by the finishing characteristics of the fibers (crimping, surface finishing, thermosetting, etc.), and by the homogeneity of distribution of the fibers entering the calender. To avoid these inconveniences and obtain a more direct evaluation of the fiber thermoweldability characteristics a method has been perfected that will be described below.

Specimens are prepared from a 400 tex roving (method ASTM D 1577-7) 0.4 meter long, made up of continuous filaments.

After the roving has been twisted eighty times, the two extremities are united, thus obtaining a product where the two halves of the roving are entwined as in a rope.

The thermobonding is carried out on said specimen using a Bruggel HSC-ETK thermowelding machine, operating at a plate temperature of 150° C., using a clamping pressure of 800N and 1 second bonding time.

A dynamometer is used to measure the average strength required to separate the two halves of the roving which constitute each specimen at the thermowelding point. The result, expressed in Newton, is obtained by averaging out at least eight measurements, and represents the thermobonding strength of the fibers.

POLYMERS SUBJECTED TO SPINNING

The polymers used in the examples to produce the fibers are the following:

Polypropylene I

Mechanical mixture of propylene homopolymer having MFRL of 13 g/10 min and a fraction soluble in xylene at 25° C. equal to 3.5% by weight, in the form of flakes with a controlled particle size distribution (average diameter of the particles 450μm), with the following additives:

| additive | concentration (by weight) |
|---|---|
| Irganox 1076 | 0.01% |
| Irganox 3114 | 0.01% |
| Irgafos 168 | 0.07% |
| Calcium stearate | 0.05% |

Said mechanical mixture has been obtained by introducing the components into a Caccia speed mixer model LABO 30, and mixing for 4 minutes at 1400 rpm.

Polypropylene II

Same composition as for Polypropylene I, but in the form of pellets, as the above said mechanical mixture has been granulated by extrusion.

Polypropylene III

Propylene homopolymer in spheroidal particle form with a diameter ranging from 2 to 3 mm, having a MFR of 12.2 g/10 min. and a fraction soluble in xylene at 25° C. equal to 4.2% by weight, surface additivated with:

| additive | concentration (by weight) |
|---|---|
| Irganox 1076 | 0.01% |
| Chimassorb 994 | 0.02% |
| Sandostab P-EPQ | 0.05% |
| Calcium stearate | 0.05% |

The Chimassorb 944 is a HALS having the formula

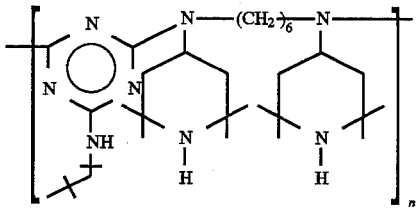

wherein n generally ranges from 2 to 20.

EXAMPLE 1

Using the above defined polypropylene I, staple fibers are prepared on a LEONARD 25 long spinning apparatus, manufactured and marketed by Costruzioni Meccaniche Leonard-Sumirago (VA)-Italy.

The set-up of the apparatus is as follows:

extruder with a screw having a 25 mm diameter and a length/diameter ratio of 25, and a flow-rate ranging from 1 to 6 Kg/h;

2.5 $cm^3$/rev. metering pump;

die having 61 round capillaries with an output diameter of 0.8 mm;

cooling system for the extruded filaments by means of transversal air jet at 18–20° C.;

take-Up apparatus with a speed ranging from 1000–6000 m/min.;

drawing apparatus in steam oven.

The following process conditions are used for the spinning operation:

| | |
|---|---|
| extruded polymer temperature | 280° C. |
| capillary flow rate | 0.3 g/min. |
| take-up speed | 1400 m/min. |
| draw ratio | 1.3 |
| draw temperature | 100° C. |
| The characteristics of the fibers obtained in this manner are: | |
| single filament denier (according to ASTM D 1577-79) | 1.7 dtex |
| thermobondability | 4.1 N |

comparative Example 1

The same polymer, apparatus and conditions of Example 1 are used, except that the die has 61 round capillaries and the output diameter is 0.4 mm.

The characteristics of the fibers obtained in this manner are:

| | |
|---|---|
| single filament denier | 1.7 dtex |
| thermobondability | 2.0 N |

EXAMPLE 2

Using the above defined polypropylene I, staple fibers with a short-spinning pilot apparatus set up as follows are prepared:

single-screw extruder with a 120 mm diameter and a length equal to 30 diameters;

150 $cm^3$/rev. metering pump;

die with $3.5\times10_4$ round capillaries and a 0.6 mm output diameter; said capillaries being situated in the form of a crown;

cooling device, coaxial to the crown of capillaries of the die, emitting 20° C. air on a plane perpendicular to the exiting filaments.

The Spinning conditions are as follows:

| | |
|---|---|
| extruded polymer temperature | 300° C. |
| capillary flow rate | 0.018 g/min. |
| distance between the die and cooling airflow | 5 mm |
| take-up speed | 70 m/min. |
| draw temperature | 80° C. |
| draw ratio | 1.4 |

The characteristics of the filaments obtained in this manner are:

| | |
|---|---|
| single filament denier | 2.3 dtex |
| thermobondability | 6.85 N |

EXAMPLE 3

The same apparatus and conditions of Example 2 are used to produce staple filaments, except that one uses the polypropylene III.

The characteristics of the filaments obtained in this manner are:

| | |
|---|---|
| single filament denier | 2.3 dtex |
| thermobondability | 6.5 N |

EXAMPLE 4

Staple fibers are produced using the same polymer, apparatus and conditions of Example 2, except that the distance between the die and the cooling airflow is 15 mm.

The characteristics of the filaments obtained in this manner are:

| | |
|---|---|
| single filament denier | 2.3 dtex |
| thermobondability | 7.6 N |

Example 5

Staple fibers are produced using the same polymer, apparatus and conditions of Example 2, except that the drawing occurs at ambient temperature.

The characteristics of the filaments obtained in this manner are:

| | |
|---|---|
| single filament denier | 2.3 dtex |
| thermobondability | 10 N |

Comparative Example 2

Staple fibers are produced using the same polymer of Example 2, an industrial apparatus made up of 8 spinning units identical to the one described in Example 2, but whose dies have $5.18\times10^4$ round capillaries having a output diameter of 0.4 mm. The spinning conditions are:

| | |
|---|---|
| extruded polymer temperature | 285° C. |
| capillary flow rate | 0.018 g/min. |
| distance between the die and cooling airflow | 5 mm |
| filament speed | 64 m/min. |
| draw temperature | 80° C. |
| draw ratio | 1.5 |
| The characteristics of the fibers obtained in this manner are: | |
| single filament denier | 2.3 dtex |
| thermobondability | 2.35 N |

Comparative Example 3

The same apparatus and conditions of Comparative example 2 are used to produce staple fibers, except that polypropylene III is used.

| | |
|---|---|
| extruded polymer temperature | 295° C. |
| capillary flow rate | 0.024 g/min. |
| distance between the die and cooling airflow | 5 mm |
| filament speed | 70 m/min. |
| draw temperature | 80° C. |
| draw ratio | 1.35 |

The characteristics of the fibers obtained in this manner are:

| | |
|---|---|
| single filament denier | 2.3 dtex |
| thermobondability | 2.2 N |

EXAMPLE 6

Using polypropylene I, fibers are prepared using a Barmag 25 mod. 2E1/24D apparatus for spun-bonding, manufactured and sold by Barmer Mashinentfabrik A.G. Manufacture. The lay out of the apparatus is as follows:

- an extruder with a screw 25 mm in diameter and a ratio length/diameter of 24; the extruder has a flow rate between 0.3 and 1.2 kg/hr;
- a metering pump of 0.6 $cm^3$/rev.
- a die with 37 capillaries of circular section having a output capillary diameter of 0.8 mm;
- a cooling system for the extruded filaments by transverse air jet at 18°–20° C.;
- an air suction gathering device using a Venturi tube, with a filament speed ranging between 500–4000 m/min.

The process conditions for spinning are as follows:

| | |
|---|---|
| extruded polymer temperature | 280° C. |
| capillary flow rate | 0.6 g/min. |
| filament speed | 2700 re/min. |
| distance between the die and the cooling air jet | 20 mm |

The characteristics of the obtained filaments are:

| | |
|---|---|
| single filament denier | 2.2 dtex |
| thermobondability | 5.4 N |

Comparative Example 4

The same polymer is used, with the same apparatus and working under the same conditions as in Example 6, except that the die has 37 circular section capillaries with an output capillary diameter of 0.4 mm.

The characteristics of the obtained filaments are:

| | |
|---|---|
| single filament denier | 2.2 dtex |
| thermbondability | 2.04 N |

EXAMPLE 7

Using polypropylene II, fibers and nonwoven fabrics are prepared with a pilot apparatus for spun-bonding made by the German company Lurgi. The layout of the apparatus is as follows:

- rectangular dies containing 931 capillaries of circular section and with an output capillary diameter of 0.9 nun.
- an air cooling device at 20° C., acting on a plane perpendicular to the emergent filaments.

The spinning conditions are as follows:

| | |
|---|---|
| extruded polymer temperature | 280° C. |
| capillary flow rate | 0.52 g/min. |

-continued

| | |
|---|---|
| distance between the die and the cooling air flow | 30 mm |
| filament speed | 2300 m/min. |

The fibers obtained under these conditions have the following characteristics:

| | |
|---|---|
| single filament denier | 2.3 dtex |
| thermobondability | 6.4 N |

EXAMPLE 8

Fibers are produced with the same apparatus and working under the same conditions as in Example 6, but using polypropylene III.

The obtained filaments have the following characteristics:

| | |
|---|---|
| single filament denier | 2.2 dtex |
| thermobondability | 5.8 N |

Comparative Example 5

Fibers are produced with the same polymer used in Example 8, and the same apparatus used in Example 6, but the die contains 37 capillaries of circular section and the output capillary diameter is equal to 0.4 mm.

The obtained filaments have the following characteristics:

| | |
|---|---|
| single filament denier | 2.2 dtex |
| thermobondability | 2.1 N |

EXAMPLE 9

Fibers are produced in the spun-bonding apparatus described in Example 6, but using polypropylene II.

The process conditions for spinning are as follows:

| | |
|---|---|
| extruded polymer temperature | 280° C. |
| capillary flow rate | 0.8 g/min |
| filament speed | 3600 m/min |
| distance between the die and the cooling air jet | 20 mm |

The characteristics of the obtained filaments are:

| | |
|---|---|
| single filament denier | 2.2 dtex |
| thermobondability | 5.1 |

Other features, advantages and embodiments of the invention disclosed herein will be readily apparent to those exercising ordinary skill after reading the foregoing disclosure. In this regard, while specific embodiments of the invention have been described in considerable detail, variations and modifications of these embodiments can be effected without departing from the spirit and scope of the invention as described and claimed.

We claim:

1. A process for the preparation of thermobondable polyolefin staple fibers, comprising spinning an olefin polymer having a MRF from 1.5 to 35 g/10 min. at a filament speed of from 40 to 250 m/min. using a short-spinning apparatus with a spinneret having capillaries having a real or equivalent output diameter greater than 0.4 mm, with the proviso that for fibers having a denier per filament greater than or equal to 4 dtex, the ratio of said output diameter to said denier per filament is greater than or equal to 0.06 mm/dtex, such that the extruded olefin polymer temperature is from 240° C. to 320° C., thereby forming themobondable fibers.

2. The process of claim 1, wherein the real or equivalent output diameter of the capillaries is from 0.5 to 2 mm.

3. The process of claim 1, wherein the real or equivalent output diameter of the capillaries is from 0.6 to 1 mm.

4. The process of claim 1, wherein the capillary flow rate is from 0.005 to 0.18 g/min. and the draw ratio is from 1.10 to 3.50.

5. The process of claim 1, wherein a pre-cooling space between a die and a fiber cooling area is greater than 2 mm.

6. The process of claim 1, wherein the draw temperature used is lower than 100° C.

7. A process for the preparation of thermobondable fibers comprising spinning an olefin polymer having a MFR from 5 to 25 g/10 min using a spun-bonding apparatus with a spinneret having capillaries having a real or equivalent output diameter greater than 0.4 mm, with the proviso that for fibers having a denier per filament greater than or equal to 4 dtex, the ratio of said output diameter to said denier per filament is greater than or equal to 0.06 mm/dtex, such that the extruded olefin polymer temperature is from 230° C. to 320° C., thereby forming thermobondable fibers.

8. The process of claim 7, wherein the capillary flow rate is from 0.1 to 2.0 g/ min. and the filament speed is from 400 to 4500 m/min.

9. The process of claim 7, wherein the olefin polymer subjected to spinning has a MFR from 8 to 18 g/10 min.

10. The process of claim 1, wherein the olefin polymer subjected to spinning is selected from the group consisting of:

1) isotactic, propylene homopolymers;

2) crystalline copolymers of propylene with at least one of ethylene and $C_4$–$C_8$ alpha-olefins, wherein the total comonomer content ranges from 0.05% to 20% by weight; and 3) heterophasic copolymers comprising (A) at least one of propylene homopolymer of item 1) and one of the copolymers of item 2), and an elastomeric fraction (B) comprising copolymers of ethylene with at least one of propylene and a $C_4$–$C_8$ alpha-olefin.

11. The process of claim 1 wherein the olefin polymer subjected to spinning contain one or more of the following stabilizers:

a) from 0.01 to 0.5% by weight of one or more organic phosphites and/or phosphonites;

b) from 0.005 to 0.5% by weight of one or more HALS; and optionally one or more phenolic antioxidants in concentrations which do not exceed 0.02% weight.

12. The process of claim 10 wherein said elastomeric fraction (B) additionally comprises a minor amount of a diene.

13. The process of claim 10, wherein the olefin polymer selected for spinning is a mixture of items 1) and 2).

14. A process for the preparation of thermobondable polyolefin staple fibers, comprising spinning an olefin polymer having a MFR from 1.5 to 35 g/10 min. at filament speed of from 40 to 250 m/min. using a short-spinning apparatus with a spinneret having capillaries having a real or equivalent output diameter greater than 0.4 mm, such that the extruded olefin polymer temperature is from 240° C. to 320° C., thereby forming thermobonable fibers, said fibers having a denier per filament of 0.5 to 3 dtex.

15. A process for the preparation of thermobondable fibers comprising spinning an olefin polymer having a MFR from 5 to 25 g/10 min. using a spun-bonding apparatus with a spinneret having capillaries having a real or equivalent output diameter greater than 0.4 mm, such that the extruded polymer temperature is from 230° C. to 320° C., thereby forming thermobondable fibers having a denier per filament of 0.5 to 3 dtex.

16. The process of claim 15 wherein the olefin polymer has a MFR from 8 to 18 g/10 min.

17. The process of claim 17 wherein the extruded olefin polymer temperature is from 240° C. to 300° C.

18. The process of claim 15 wherein the extruded olefin polymer temperature is from 240° C. to 300° C.

19. The process of claim 1 wherein the extruded olefin polymer temperature is from 270° C. to 300° C.

20. The process of claim 14 wherein the extruded olefin polymer temperature is from 270° C. to 300° C.

* * * * *

UNITED STATES PATENT AND TRADEMARK OFFICE

CERTIFICATE OF CORRECTION

PATENT NO. : *5,660,789*

DATED : *August 26, 1997*

INVENTOR(S) : *Leonardo Spagnoli et al*

It is certified that error appears in the above-indentified patent and that said Letters Patent is hereby corrected as shown below:

*At col. 10, line 36, change "3.5x10$_4$" to --3.5x10$^4$--.*

*At col. 11, line 56, the words --The spinning conditions are:-- should be added.*

*At col. 12, line 28, on the same line as filament speed, change "2700 re/min." to --2700 m/min.--.*

*At col. 12, lines 58 & 59, change "0.9 nun" to --0.9 mm--.*

Signed and Sealed this

Sixteenth Day of June, 1998

*Attest:*

Bruce Lehman

BRUCE LEHMAN

*Attesting Officer*

*Commissioner of Patents and Trademarks*